US010485292B2

(12) United States Patent
Buck, IV et al.

(10) Patent No.: US 10,485,292 B2
(45) **Date of Patent: *Nov. 26, 2019**

(54) HEEL DAMPENING SYSTEMS AND FOOTWEAR INCLUDING THE SAME

(71) Applicant: Ariat International, Inc., Union City, CA (US)

(72) Inventors: Calvin Myron Buck, IV, Washougal, WA (US); Marco Aurelio Grott, Pleasanton, CA (US)

(73) Assignee: Ariat International, Inc., Union City, CA (US)

( * ) Notice: Subject to any disclaimer, the term of this patent is extended or adjusted under 35 U.S.C. 154(b) by 201 days.

This patent is subject to a terminal disclaimer.

(21) Appl. No.: 15/785,255

(22) Filed: Oct. 16, 2017

(65) Prior Publication Data

US 2018/0035747 A1 Feb. 8, 2018

Related U.S. Application Data

(63) Continuation of application No. 15/233,793, filed on Aug. 10, 2016, now Pat. No. 9,814,280.
(Continued)

(51) Int. Cl.
*A43B 7/32* (2006.01)
*A43B 21/32* (2006.01)
*A43B 7/14* (2006.01)

(52) U.S. Cl.
CPC ..... *A43B 7/32* (2013.01); *A43B 7/144* (2013.01); *A43B 21/32* (2013.01)

(58) Field of Classification Search
CPC .. A43B 7/144; A43B 7/14; A43B 7/32; A43B 21/32; A43B 21/26; A43B 21/08; A43B 13/181; A43B 13/18
(Continued)

(56) References Cited

U.S. PATENT DOCUMENTS 451,200 A * 4/1891 Manny ..... A43B 21/06 36/35 R
479,560 A * 7/1892 Drake ..... A43B 13/34 36/34 R
(Continued)

FOREIGN PATENT DOCUMENTS

CH 391510 A 9/1965
CN 2922548 Y 7/2007
(Continued)

OTHER PUBLICATIONS

English-language machine translation of Swiss Patent No. CH 391510 A, European Patent Office, Sep. 15, 1965.
(Continued)

*Primary Examiner* — Shaun R Hurley
*Assistant Examiner* — Bao-Thieu L Nguyen
(74) *Attorney, Agent, or Firm* — Dascenzo Intellectual Property Law, P.C.; David S. D'Ascenzo

(57) ABSTRACT

Heel dampening systems and footwear including the same. Articles of footwear include an upper and a sole assembly. The sole assembly includes at least an outsole and a heel assembly. The heel assembly includes a heel dampening system, an upper heel layer that includes a cushion aperture, and a lower heel layer. The heel dampening system includes a heel dampening layer configured to at least partially absorb an impact force and a cushioning projection that extends from the heel dampening layer and at least partially through the cushion aperture in the upper heel layer.

25 Claims, 5 Drawing Sheets

Related U.S. Application Data

(60) Provisional application No. 62/204,376, filed on Aug. 12, 2015.

(58) Field of Classification Search
USPC ..... 36/102, 117.3, 3 B, 15, 22 A, 25 R, 28, 36/30 R, 34 R, 35 R, 36 R, 37, 38
See application file for complete search history.

(56) References Cited

U.S. PATENT DOCUMENTS 951,605 A * 3/1910 Hammer ..... A43B 7/142 36/147
976,552 A 11/1910 Cook
1,241,643 A * 10/1917 Mansbach ..... A43B 13/34 36/34 R
1,471,966 A * 10/1923 Light ..... A43B 13/183 36/38
1,542,174 A 6/1925 Robidoux
1,920,112 A * 7/1933 Shaft ..... A43B 21/32 36/28
1,942,001 A * 1/1934 Rohn ..... A43B 13/187 36/17 R
1,947,922 A * 2/1934 Raut ..... A43B 13/41 36/68
2,048,683 A * 7/1936 Brockman ..... A43B 21/26 36/35 R
2,078,311 A 4/1937 Boag
2,150,385 A * 3/1939 Maling ..... A43B 13/37 36/11.5
2,863,230 A * 12/1958 Cortina ..... A43B 13/20 36/29
3,050,875 A * 8/1962 Robbins ..... A43B 7/06 36/3 B
3,478,447 A * 11/1969 Foster ..... A43B 21/433 36/36 B
3,822,490 A * 7/1974 Murawski ..... A43B 21/26 36/105
4,224,749 A 9/1980 Diaz-Cano
4,342,158 A * 8/1982 McMahon ..... A43B 21/26 36/114
4,492,046 A * 1/1985 Kosova ..... A43B 13/183 36/27
4,566,206 A * 1/1986 Weber ..... A43B 21/26 36/27
5,060,401 A * 10/1991 Whatley ..... A43B 13/18 36/114
5,152,081 A 10/1992 Hallenbeck et al.
5,400,527 A * 3/1995 Marega ..... A43B 5/0405 36/117.3
5,649,374 A 7/1997 Chou
5,743,028 A * 4/1998 Lombardino ..... A43B 13/182 36/27
6,115,943 A * 9/2000 Gyr ..... A43B 13/141 36/28
6,269,555 B1 * 8/2001 Brown ..... A43B 7/14 36/144
6,272,773 B1 8/2001 Sjösvärd
6,330,757 B1 * 12/2001 Russell ..... A43B 13/143 36/27
6,497,057 B1 12/2002 Lee et al.
6,568,102 B1 * 5/2003 Healy ..... A43B 13/187 36/27
6,665,958 B2 * 12/2003 Goodwin ..... A43B 13/12 36/29
6,685,011 B2 * 2/2004 Nishiwaki ..... A43B 7/144 36/28
6,722,058 B2 * 4/2004 Lucas ..... A43B 3/0063 36/28
6,874,257 B2 * 4/2005 Erickson ..... A43B 1/0072 36/103
6,920,705 B2 * 7/2005 Lucas ..... A43B 3/0063 36/142
6,931,765 B2 * 8/2005 Lucas ..... A43B 3/0063 36/28
7,020,988 B1 4/2006 Holden et al.
7,080,467 B2 * 7/2006 Marvin ..... A43B 13/189 36/28
7,082,700 B2 * 8/2006 Meschan ..... A43B 21/26 36/15
7,152,339 B2 * 12/2006 Lo ..... A43B 7/08 36/3 R
7,249,425 B2 * 7/2007 Wang ..... A43B 7/144 36/29
7,334,349 B2 * 2/2008 Sokolowski ..... A43B 13/125 36/25 R
7,380,353 B2 6/2008 Feller et al.
7,395,613 B2 7/2008 Schoenborn et al.
7,395,616 B2 * 7/2008 Fallon ..... A43B 3/0042 36/25 R
7,536,809 B2 * 5/2009 Meschan ..... A43B 21/26 36/25 R
7,814,683 B2 * 10/2010 Lee ..... A43B 13/026 36/25 R
7,950,167 B2 * 5/2011 Nakano ..... A43B 13/186 36/28
8,056,261 B2 11/2011 Nakano et al.
8,056,262 B2 11/2011 Lindqvist et al.
8,365,439 B2 * 2/2013 Koh ..... A43B 3/0047 36/15
8,863,408 B2 * 10/2014 Schindler ..... A43B 13/20 36/29
9,420,849 B2 * 8/2016 Gishifu ..... A43B 13/203
9,480,298 B2 * 11/2016 Barnes ..... A43B 7/144
9,578,924 B2 * 2/2017 Rupprecht ..... A43B 7/144
9,814,280 B2 * 11/2017 Buck, IV ..... A43B 7/32
2001/0005946 A1 * 7/2001 Brown ..... A43B 1/0018 36/28
2002/0133980 A1 * 9/2002 Pan ..... A43B 21/24 36/100
2004/0107601 A1 * 6/2004 Schmid ..... A43B 13/12 36/28
2005/0102858 A1 * 5/2005 Yen ..... A43B 3/0052 36/28
2006/0048411 A1 3/2006 Lindqvist et al.
2006/0096125 A1 * 5/2006 Yen ..... A43B 3/0063 36/35 B
2006/0213091 A1 * 9/2006 Ometto ..... A43B 7/081 36/141
2007/0017122 A1 1/2007 Feller et al.
2007/0022628 A1 * 2/2007 Juan ..... A43B 7/06 36/3 B
2007/0084081 A1 * 4/2007 Fallon ..... A43B 3/0042 36/28
2008/0010868 A1 * 1/2008 Tsai ..... A43B 1/0081 36/141
2008/0289218 A1 * 11/2008 Nakano ..... A43B 13/186 36/88
2010/0095551 A1 * 4/2010 Gupta ..... A43B 7/144 36/29
2010/0122471 A1 5/2010 Edington et al.
2010/0223811 A1 * 9/2010 Meschan ..... A43B 3/0042 36/91
2011/0126422 A1 * 6/2011 Vattes ..... A43B 7/144 36/10
2012/0047770 A1 * 3/2012 Dean ..... A43B 21/30 36/103
2013/0019502 A1 * 1/2013 Kwon ..... A43B 7/1465 36/102
2013/0061494 A1 3/2013 Linth
2013/0160331 A1 * 6/2013 Burke ..... A43B 1/0081 36/25 R
2014/0033570 A1 * 2/2014 Peyton ..... A43B 13/20 36/102
2014/0310982 A1 * 10/2014 Delattre ..... A43B 3/0052 36/28
2015/0013191 A1 * 1/2015 Brown ..... A43B 21/00 36/102

(56) References Cited

U.S. PATENT DOCUMENTS

| | | | | |
|---|---|---|---|---|
| 2015/0040435 | A1* | 2/2015 | Barnes | A43B 13/183 36/102 |
| 2015/0245687 | A1* | 9/2015 | Taylor | B29D 35/122 12/146 B |
| 2015/0327624 | A1 | 11/2015 | Grott et al. | |
| 2016/0015123 | A1* | 1/2016 | Peyton | A43B 5/06 36/102 |

FOREIGN PATENT DOCUMENTS

| | | | |
|---|---|---|---|
| CN | 201045891 | Y | 4/2008 |
| CN | 201640673 | U | 11/2010 |
| CN | 202407315 | U | 9/2012 |
| CN | 202635774 | U | 1/2013 |
| EP | 0749705 | B1 | 7/1999 |
| WO | WO 90/11700 | A1 | 10/1990 |
| WO | WO 2004/047580 | A1 | 6/2004 |
| WO | WO 2007/113595 | A2 | 10/2007 |

OTHER PUBLICATIONS

English-language machine translation of European Patent No. EP 0749705 B1, obtained with European Patent No. EP 0749705 B1, Jul. 7, 1999.

English-language machine translation of China Patent No. CN 2922548 Y, obtained with China Patent No. CN 2922548 Y, Jul. 18, 2007.

English-language machine translation of China Patent No. CN 201045891 Y, obtained with China Patent No. CN 201045891 Y, Apr. 16, 2008.

English-language machine translation of China Patent Publication No. CN 201640673 U, obtained with China Patent Publication No. CN 201640673 U, Nov. 24, 2010.

English-language machine translation of China Patent Publication No. CN 202407315 U, obtained with China Patent Publication No. CN 202407315 U, Sep. 5, 2012.

English-language machine translation of China Patent Publication No. CN 202635774 U, obtained with China Patent Publication No. CN 202635774 U, Jan. 2, 2013.

* cited by examiner

HEEL DAMPENING SYSTEMS AND FOOTWEAR INCLUDING THE SAME

RELATED APPLICATIONS

This application claims priority under 35 U.S.C. § 120 to U.S. patent application Ser. No. 15/233,793, which was filed on Aug. 10, 2016, issued as U.S. Pat. No. 9,814,280 on Nov. 14, 2017, and which claims priority under 35 U.S.C. § 119(e) to U.S. Provisional Patent Application Ser. No. 62/204,376, which was filed on Aug. 12, 2015. The complete disclosures of the above-identified patent applications are hereby incorporated by reference.

FIELD OF THE DISCLOSURE

The present disclosure is directed generally to footwear, and more particularly to footwear that includes a heel dampening system to dampen impact forces imparted to the heel of the footwear.

BACKGROUND OF THE DISCLOSURE

Heeled footwear, such as boots, are worn for a variety of applications, including as Western (cowboy) boots, riding (equestrian) boots, work boots, and hiking boots. In many examples, the heel portion of an article of footwear is the first point of contact between the footwear and the ground, such that mechanical energy is transmitted into the heel region of the footwear and into the heel of the individual wearing the footwear each time the heel of the footwear strikes the ground or other solid surface. This mechanical energy further may be transferred through the wearer's skeletal structure, such as from the individual's heel toward the individual's skull. The mechanical energy transferred into the heel of the wearer, such as during the cycle of a walking gait, while running, or when dismounting an animal, may be uncomfortable or even injurious to the wearer. The transferred mechanical energy may be greatest during high-magnitude impacts, such as after jumping or dismounting from an animal or other object. Thus, there exists a need for heel dampening systems and footwear including the same.

SUMMARY OF THE DISCLOSURE

Heel dampening systems and footwear including the same are disclosed herein. Articles of footwear according to the present disclosure include an upper configured to receive a wearer's foot when the footwear is worn by the wearer and a sole assembly coupled to the upper. The sole assembly includes an outsole, which has an outer surface configured to contact a surface on which the wearer is striding, and a heel assembly. The sole assembly may further include a midsole adjacent to an inner surface of the outsole.

The heel assembly projects from the outsole and has an anterior side, a posterior side, a lateral side, and a medial side. The heel assembly includes a heel dampening system, an upper heel layer located generally above the heel dampening system, and a lower heel layer located generally below the heel dampening layer. The upper heel layer includes a cushion aperture that extends through the upper heel layer from an upper surface of the upper heel layer to a lower surface of the upper heel layer. The upper heel layer and the lower heel layer may extend from the medial side of the heel assembly to the lateral side of the heel assembly.

The heel dampening system includes a heel dampening layer that extends from the posterior side of the heel assembly toward the anterior side of the heel assembly and which may extend from the medial side of the heel assembly to the lateral side of the heel assembly. The heel dampening layer is configured to at least partially absorb an impact force when the heel assembly impacts the ground surface. The heel dampening system further includes a cushioning projection that extends from the heel dampening layer and at least partially through the cushion aperture in the upper heel layer.

DETAILED DESCRIPTION AND BEST MODE OF THE DISCLOSURE

Figure 1:
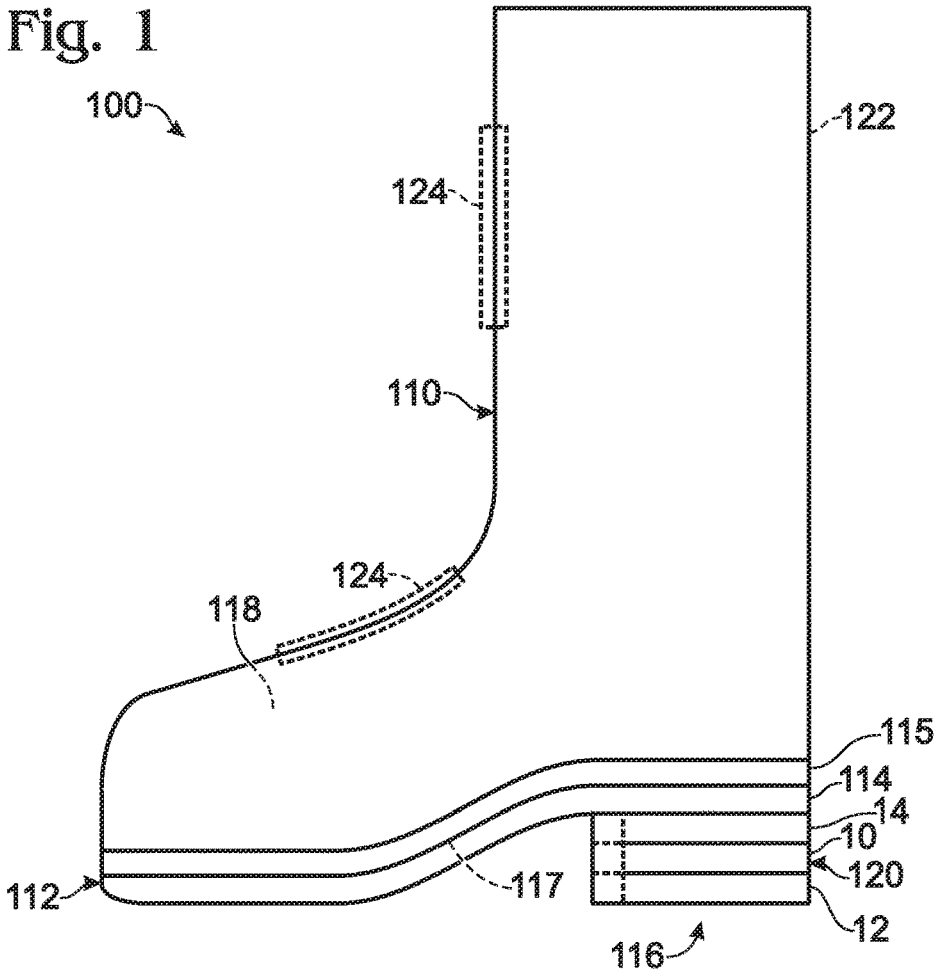
FIG. 1 is a schematic representation of an article of footwear having a heel assembly with a heel dampening system according to the present disclosure.

Articles of footwear according to the present disclosure are schematically illustrated in FIG. 1 and generally indicated at 100. As illustrated in FIG. 1, footwear 100 according to the present disclosure includes an upper 110 and a sole assembly 112 coupled to the upper. Upper 110 may be described as including and/or being a shell of the footwear, and in the case of footwear 100 in the form of boots, also may be described as including a shaft 122 that extends along the wearer's leg, such as to and/or above an Achilles region of the wearer's leg. Although only schematically illustrated in FIG. 1, it is within the scope of the present disclosure that upper 110 may include, or alternatively may be free from, one or more adjustable mechanical fasteners 124 to selectively constrain or otherwise reduce the size of upper 110. Examples of such mechanical fasteners include laces, snaps, buckles, and hook-and-loop fasteners.

Sole assembly 112 includes an outsole 114 and a heel assembly 116 that includes a heel dampening system 120. Sole assembly 112 may further include a midsole 115, which may be adjacent and/or in contact with an upper surface of outsole 114. Sole assembly 112, and/or midsole 115 thereof, further may include a shank 117 that reinforces at least an arch region of the sole assembly. Shank 117 may be stiffer and/or more rigid than a remainder of sole assembly 112 and/or midsole 115, and/or may be configured to increase a rigidity of at least a portion of sole assembly 112. Sole assembly 112 and upper 110 collectively define a foot compartment, or foot chamber, 118 that is sized to receive a wearer's foot when the article of footwear is worn by the wearer. Heel assembly 116 may be an external heel assembly that projects generally downward from a posterior end of outsole 114 and/or of sole assembly 112.

As used herein, heel assembly 116 also may be referred to as a heel 116, an external heel assembly 116, a stacked heel 116, and/or a stacked heel assembly 116. As used herein, footwear 100 also may be referred to as article 100, article of footwear 100, and/or boot 100. As used herein, heel dampening system 120 also may be referred to as a heel dampening assembly 120, a heel dampening structure 120, a heel cushioning system 120, a heel cushioning assembly 120, and/or a heel cushioning structure 120. Heel assembly 116 projects from outsole 114 and includes an anterior (front) side; a posterior (rear) side; a lateral (outer) side; and a medial (inner) side.

Generally, heel dampening system 120 is configured to provide cushioning, impact dampening, and/or energy return to a wearer of footwear 100. Heel dampening system 120 generally includes a heel dampening layer 10 that is configured to enhance the cushioning properties of heel assembly 116. Heel dampening system 120 may further include one or more additional elements that are configured to modify the cushioning properties of heel dampening layer 10, to enhance the structural stability of heel assemblies 116 that include heel dampening layer 10, and/or to provide a resilient energy return mechanism to heel assembly 116.

The examples illustrated and discussed herein generally relate to heeled footwear with external heel assemblies 116, that is, heel assemblies 116 that are operatively attached to and/or project from outsole 114 and/or sole assembly 112 of footwear 100. However, the present disclosure is not limited to heeled footwear with external heel assemblies. For example, the various components and characteristics of footwear 100 disclosed herein also may be used with footwear with an incorporated heel assembly, such as may be present in athletic or casual footwear in which the heel assembly does not project from the outsole of the footwear.

In the Figures, the same reference numerals are intended to designate like and corresponding, but not necessarily identical, elements through the various Figures. Accordingly, when like-numbered elements are shown in two or more Figures, they may not be discussed in each such Figure, and it is within the scope of the present disclosure that the discussion, including variants referred to therein, shall apply unless otherwise indicated. Similarly, where like-numbered elements, including illustrative values, materials, constructions, variants thereof, and the like, are described in two or more portions of the present disclosure and/or in connection with two or more Figures, it is within the scope of the present disclosure that these illustrative values, materials, constructions, variants thereof, and the like may be applied even if not repeated in the discussion at each occurrence.

As used herein, the terms "upper," "above," "top," "lower," "below," "bottom," and similar terms as used to describe spatial relationships between components of footwear 100, and/or between a component of footwear 100 and a ground surface or other object, are considered from the perspective of footwear 100 positioned in an upright orientation on a level ground surface. Accordingly, an upper surface, or upper side, refers to a surface or side of a component that generally faces away from the ground surface, and a lower surface, or lower side, refers to a surface or side that generally faces toward the ground surface.

As used herein, the terms "medial," "central," "lateral," "anterior," "posterior," and similar terms as used to describe spatial relationships between components of footwear 100 are considered from the perspective of footwear 100 when worn by a wearer standing upright on a level ground surface. Accordingly, a medial surface, or medial side, refers to a surface or side of a component that is proximal a midline of a wearer's body, while a lateral surface, or lateral side, refers to a surface or side of a component that is distal the midline of a wearer's body relative to a medial surface or side. For example, a medial side of footwear 100 worn on the wearer's right foot generally refers to a left side of footwear 100, whereas a lateral side of footwear 100 worn on a wearer's right foot generally refers to a right side of footwear 100. Similarly, an anterior surface, anterior end, or anterior side refers to a surface, end, or side of a component that is proximal a toe of a wearer relative to a heel of the wearer, whereas a posterior surface, posterior end, or posterior side refers to a surface, end, or side of a component that is proximal a heel of a wearer relative to a toe of the wearer. The respective "sides" additionally or alternatively may be referred to as ends and/or edges.

Figure 2:
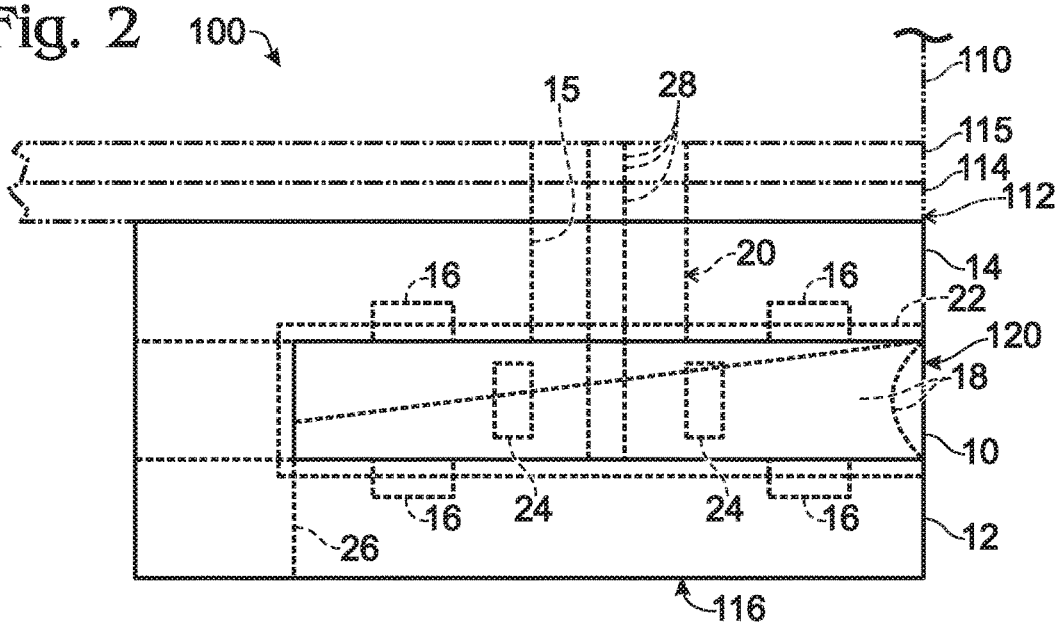
FIG. 2 is a fragmentary schematic representation of articles of footwear with a heel assembly with a heel dampening system according to the present disclosure.

Heel assemblies 116 according to the present disclosure include heel dampening systems 120 that include a heel dampening layer 10. As used herein, heel dampening layer 10 additionally or alternatively may be referred to as heel dampening structure 10, heel cushioning layer 10, or heel cushion 10. Heel assembly 116 additionally may include a lower heel layer 12 and/or an upper heel layer 14. As illustrated in FIG. 2, and as discussed in more detail herein, heel dampening systems 120, and heel assemblies 116 and footwear 100 incorporating the same, additionally may include one or more of at least one heel locator 16, at least one sidewall indentation 18, a cushioning projection 20, an assist frame 22, at least one compliance-modifying insert 24, and/or a heel breast joint 26.

As illustrated in FIG. 2, heel assembly 116 may be a stacked heel assembly in which lower heel layer 12, heel dampening layer 10, and upper heel layer 14 are arranged in a generally stacked configuration. Stated differently, heel assembly 116 may be a stacked heel assembly in which lower heel layer 12 is positioned generally, at least partially, and/or entirely below heel dampening layer 10 and in which upper heel layer 14 is positioned generally, at least partially, and/or entirely above heel dampening layer 10. However, it is additionally within the scope of the present disclosure that heel assembly 116 may be a stacked heel assembly in which at least a portion of lower heel layer 12 extends above at least a portion of heel dampening layer 10, such as by projecting upwardly past a side of the heel dampening layer, and/or in which at least a portion of upper heel layer 14 extends below at least a portion of heel dampening layer 10, such as by projecting downwardly past a side of the heel dampening layer. Additionally or alternatively, and as illustrated in FIG. 2, upper heel layer 14 may include a cushion aperture 15 that extends through upper heel layer 14 from a bottom side of upper heel layer 14 to a top side of upper heel layer 14. Stated differently, cushion aperture 15 may include and/or be a hole in upper heel layer 14 that connects the top side of upper heel layer 14 and the bottom side of upper heel layer 14. Cushion aperture 15 and/or heel assembly 116 may be configured such that a portion of heel dampening layer 10 and/or cushioning projection 20 extends at least partially, and optionally fully, through and/or even out of cushion aperture 15.

Figure 3:
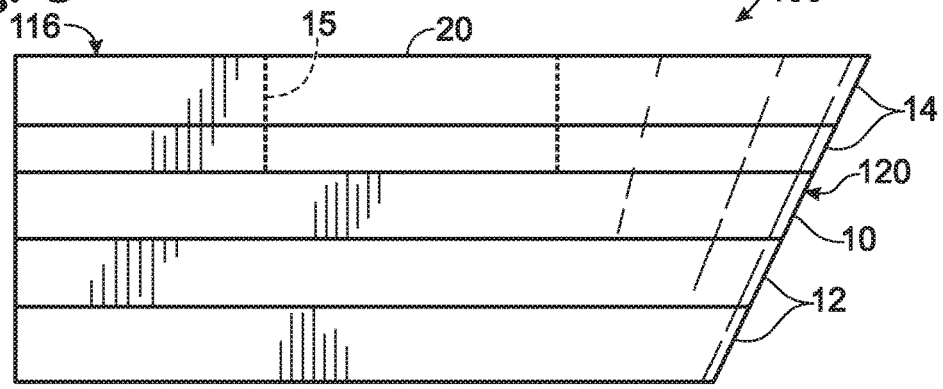
FIG. 3 is a side elevation view of a stacked external heel assembly with a heel dampening system according to the present disclosure.

As illustrated in FIG. 3, heel assembly 116 of footwear 100 that includes heel dampening system 120 according to the present disclosure includes a heel dampening layer 10, a lower heel layer 12 positioned generally beneath the heel dampening layer, and an upper heel layer 14 positioned generally above the heel dampening layer. Lower heel layer 12 and/or upper heel layer 14 each may be formed of a single layer of one or more materials. However, this is not required, and it is additionally within the scope of the present disclosure that lower heel layer 12 and/or upper heel layer 14 each may be formed of and/or include a plurality of stacked layers, as illustrated in FIG. 3. For example, lower heel layer 12 may include a ground-contacting layer positioned below one or more additional layers, with each layer of lower heel layer 12 being formed of the same or different materials. Examples of materials that may be used in the construction of one or both of lower heel layer 12 and upper heel layer 14 include rubber, leather, wood, resins, polymers, and variations and combinations thereof.

Heel dampening layer 10 may have a different material construction and/or hardness than one or both of lower heel layer 12 and/or upper heel layer 14. For example, heel dampening layer 10 may be constructed of a material that is less hard and/or more compliant than either or both of lower heel layer 12 and upper heel layer 14. As a more specific example, heel dampening layer 10 may include a material with a Shore A durometer value of at least 30, at least 40, at least 50, at least 55, at least 60, at least 70, at most 80, at most 65, at most 60, at most 55, at most 50, at most 45, at most 40, and/or at most 35. Examples of materials that may be used in the construction of heel dampening layer 10 include ethylene vinyl acetate (EVA), thermoplastic polyurethane (TPU), thermoplastic elastomer (TPE), rubber, a filled shell, a gas-filled shell, a gel-filled shell, and variations and combinations thereof.

Figure 4:
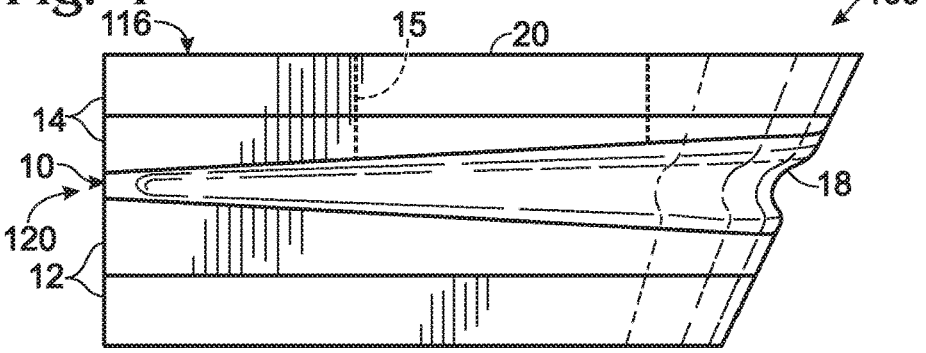
FIG. 4 is a side elevation view of a stacked external heel assembly with a heel dampening system according to the present disclosure.
Figure 5:
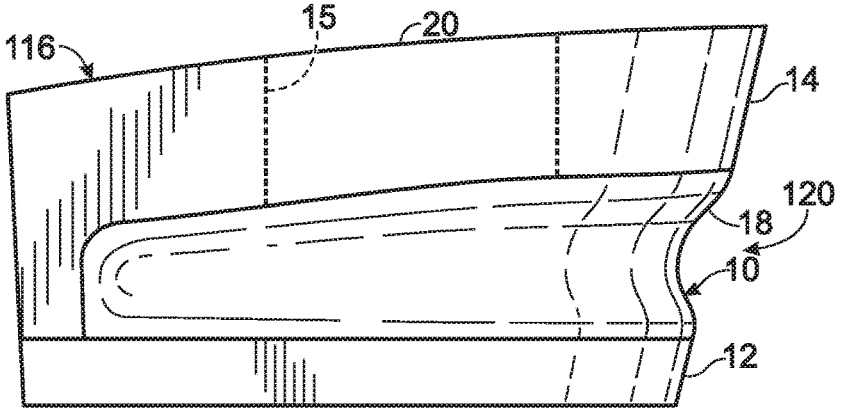
FIG. 5 is a side elevation view of a stacked external heel assembly with a heel dampening system according to the present disclosure.

Heel dampening layer 10 may extend across a full length of heel assembly 116, that is, from the posterior side of heel assembly 116 to the anterior side of heel assembly 116, as illustrated in FIGS. 3-4. Alternatively, heel dampening layer 10 may extend across only a portion of the length of heel assembly 116. For example, heel dampening layer 10 may extend from the posterior side of heel assembly 116 toward the anterior side of heel assembly 116 to a region proximate, but not extending through, the breast of the heel, as illustrated in FIG. 5. Stated differently, heel dampening layer 10 may extend from the posterior side of heel assembly 116 toward, but not to, the anterior side of heel assembly 116.

As used herein, a first component that is described as extending across a second component and/or extending from one side of the second component to another side of the second component equivalently may be described as extending fully from one side of the second component to another side of the second component. Additionally or alternatively, such a description may describe a configuration in which the first component extends from one edge and/or terminal extent of the second component to another edge and/or terminal extent of the second component; from one edge and/or terminal extent of the second component to a region short of, but proximate, the other edge and/or terminal extent of the second component; and/or from one edge and/or terminal extent of the second component to and beyond the other edge and/or terminal extent of the second component. As examples, in an embodiment in which heel dampening layer 10 extends across heel assembly 116, from the posterior side of the heel assembly to the anterior side of the heel assembly, heel dampening layer 10 may extend across at least 80%, at least 85%, at least 90%, at least 95%, 100%, at least 100%, at least 105%, at least 110%, at least 115%, at most 120%, at most 117%, at most 112%, at most 107%, at most 102%, at most 97%, at most 92%, at most 87%, and/or at most 82% of a distance between the posterior edge of heel assembly 116 and the anterior edge of heel assembly 116. In such a configuration, heel dampening layer 10 may be described as extending across a full length of heel assembly 116 regardless of the presence of a sidewall indentation 18, as described herein, that may reduce a linear dimension of portions of heel dampening layer 10, as measured in a plane containing sidewall indentation 18.

As used herein, a first component that is described as extending from one side of a second component toward, but not to, another side of the second component may describe a configuration in which the first component extends from one edge and/or terminal extent of the second component to a region proximate the other edge and/or terminal extent of the second component without reaching the other edge and/or terminal extent of the second component. As examples, in an embodiment in which heel dampening layer 10 extends from the posterior side of heel assembly 116 toward, but not to, the anterior side of heel assembly 116, heel dampening layer 10 may extend across at least 60%, at least 65%, at least 70%, at least 75%, at least 80%, at least 85%, at least 90%, and/or at least 95% of a distance between the posterior edge of heel assembly 116 and the anterior edge of heel assembly 116, while also extending at most 97%, at most 92%, at most 87%, at most 82%, at most 77%, at most 72%, at most 67%, and/or at most 62% of the distance between the posterior edge of heel assembly 116 and the anterior edge of heel assembly 116.

As used herein, the term "across" as used to describe a manner in which a first component extends relative to a second component may refer to an extent in a single linear dimension, such as along a length of the second component; may refer to an extent in each of two linear dimensions, such as along each of a length and a width of the second component; and/or may refer to an extent in each of, or any appropriate combination of, any appropriate number of linear dimensions.

In a configuration in which heel dampening layer 10 extends from the posterior side of heel assembly 116 toward, but not to, the anterior side of heel assembly 116, an external surface of the breast of the heel may be formed from one or both of lower heel layer 12 and upper heel layer 14, as illustrated in FIG. 5, and/or may be formed from a separate component of the heel assembly, such as a component that extends between and/or anterior/forward of lower heel layer 12 and upper heel layer 14. Such configurations may be desirable when utilized in footwear that is intended for activities in which the breast of the heel is expected to engage structures that may damage the breast of the heel if the breast of the heel is not sufficiently rigid, such as by being more rigid than heel dampening layer 10. An example of such an activity is horseback riding, in which the breast of the heel is expected to engage a riding stirrup. Other examples include motorcycle riding, in which the breast is expected to engage a motorcycle's foot peg, and work/industrial activities that regularly involve climbing ladders, and thus in which the breast is expected to engage the rungs of a ladder.

Figure 11:
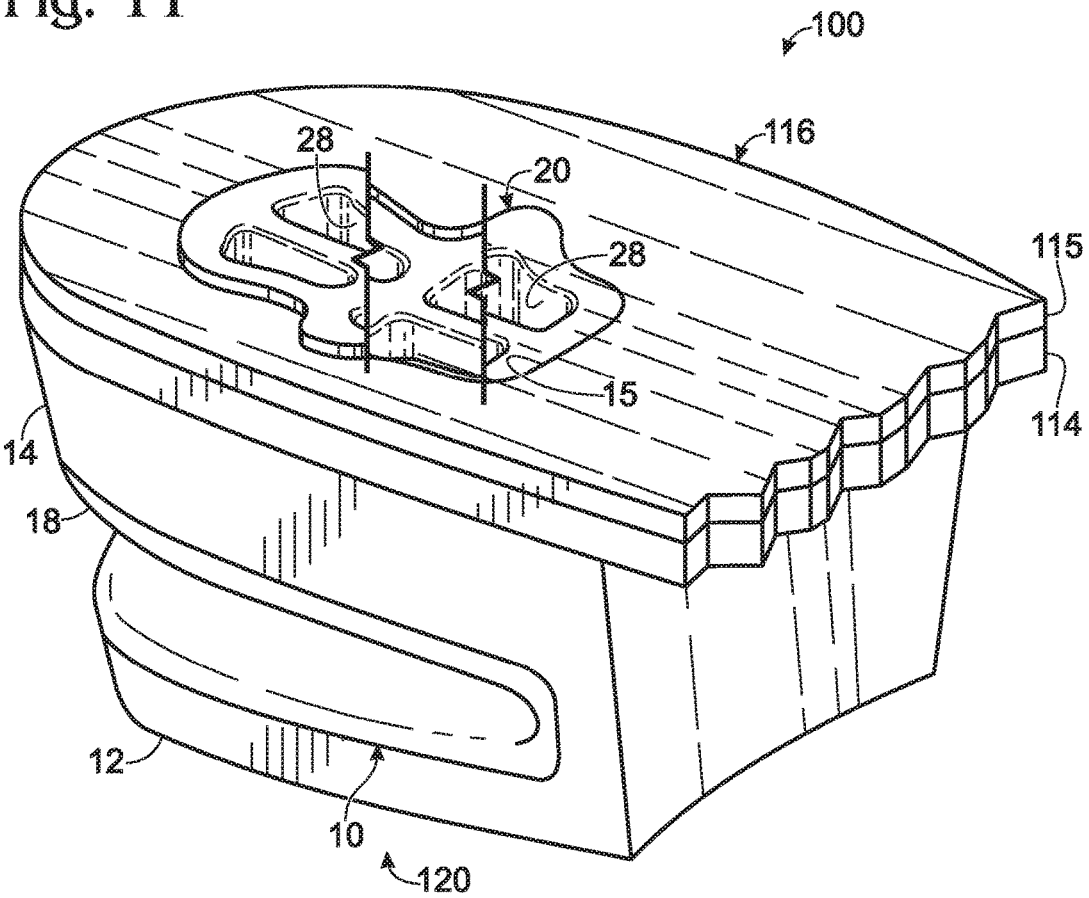
FIG. 11 is a fragmentary front perspective view of components of an article of footwear with a stacked external heel assembly according to the present disclosure.

In a heel assembly 116 in which heel dampening layer 10 extends across only a portion of the length of the heel, components of heel assembly 116 immediately below and above heel dampening layer 10 may be connected continuously at the anterior (front) end of the heel, such as is illustrated in FIG. 11. In such an assembly, lower heel layer 12 and upper heel layer 14 may be integrally formed, and/or may refer to the components of heel assembly 116 immediately below and above heel dampening layer 10, respectively, even when these terms refer not to distinct components but rather separate portions of a single component encompassing heel dampening layer 10. Alternatively, in a heel assembly 116 in which heel dampening layer 10 extends across only a portion of the length of the heel, it may be the case that lower heel layer 12 and upper heel layer 14 refer to distinct components that are joined and/or coupled at or near the breast of heel assembly 116, for example in a heel breast joint 26, as discussed in more detail herein.

Heel dampening layer 10 additionally or alternatively may have a constant, or generally constant, thickness, as illustrated in FIG. 3, or may be thicker in some regions of heel assembly 116 and thinner in others. For example, and as illustrated in FIG. 4, heel dampening layer 10 may be generally wedge-shaped, such that the thickness of heel dampening layer 10 decreases from the posterior side of the heel toward the breast of the heel.

As schematically illustrated in FIG. 2, heel dampening systems 120 according to the present disclosure may include a cushioning projection 20 configured to augment the cushioning and/or force-absorbing properties of heel dampening layer 10. Cushioning projection 20 may be positioned to lie, or otherwise extend, generally underneath a calcaneus bone of the foot of the wearer when footwear 100 is worn by the wearer so as to provide additional cushioning to the heel region of the wearer's foot. Cushioning projection 20 may include and/or form a portion of heel dampening layer 10, such as by extending or projecting upwardly from a generally planar horizontal body of the heel dampening layer. Alternatively, the cushioning projection may be a separate structure that is secured to, coupled to, or otherwise positioned above the upper surface of heel dampening layer 10.

Figure 10:
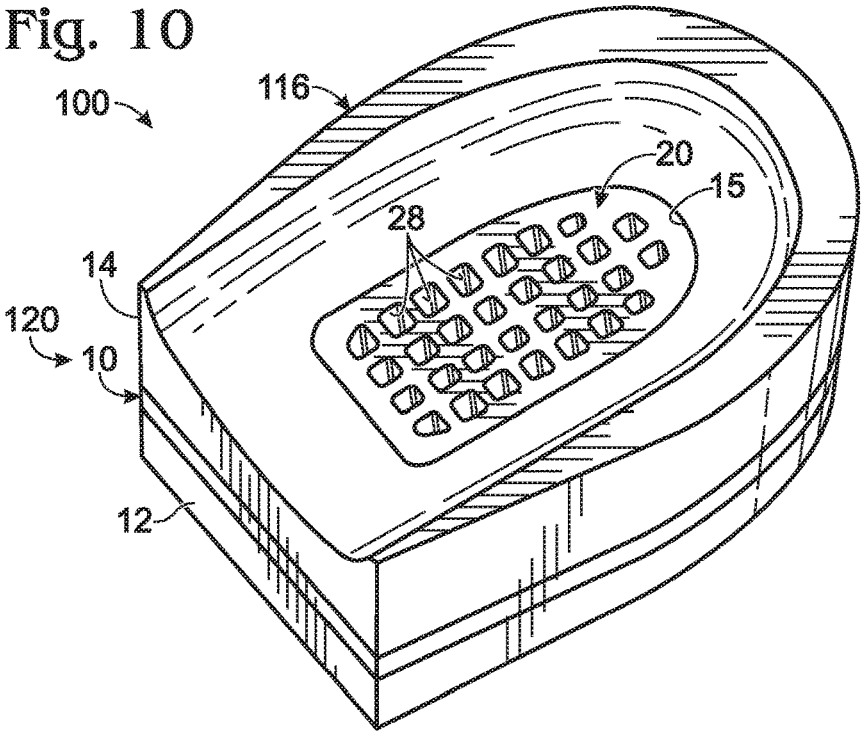
FIG. 10 is a top perspective view of a stacked external heel assembly with a heel dampening system according to the present disclosure.

As illustrated schematically in FIG. 2 and less schematically in FIGS. 3-5 and 8-11, cushioning projection 20 may be a cushioning element that projects upwards from the body of heel dampening layer 10. For example, upper heel layer 14 may include cushion aperture 15 that extends at least partially, and optionally fully, through the upper heel layer, and cushioning projection 20 may extend into cushion aperture 15. As perhaps best seen in FIGS. 9-11, cushioning projection 20 may further extend at least partially through upper heel layer 14 and/or at least partially through cushion aperture 15, and/or may extend fully through upper heel layer 14 and/or cushion aperture 15 such that a top surface of cushioning projection 20 is generally coextensive with the top surface of upper heel layer 14, as illustrated in FIG. 10. Additionally or alternatively, cushioning projection 20 may extend out of the cushion aperture, such as at least partially, and optionally fully, through outsole 114 and/or midsole 115. For example, as illustrated in solid lines in FIG. 11, the top surface of cushioning projection 20 may be generally coextensive with the top surface of midsole 115. Alternatively, and as illustrated in dash-dot-dot lines in FIG. 11, the top surface of cushioning projection 20 may extend to a point above the top surface of midsole 115, or may extend to a point below the top surface of midsole 115. It is within the scope of the present disclosure that cushioning projection 20 may extend higher than the top surface of outsole 114, midsole 115, or to any other suitable height.

Cushioning projection 20 according to the present disclosure may be generally surrounded by the materials through which it projects. For example, a generally vertical sidewall of cushioning projection 20 may be generally in contact with the surrounding material, such as of upper heel layer 14, of an inner sidewall of cushion aperture 15, and/or of midsole 115. However, an interface between cushioning projection 20 and the components through which it projects may be configured to allow for relative motion of the cushioning projection and the adjacent layers, such as to facilitate a capacity for cushioning projection 20 to compress and/or deform resiliently upon receiving an impact force.

Cushioning projection 20 may be integrally formed with heel dampening layer 10, or may be formed separately from and subsequently attached to heel dampening layer 10. Cushioning projection 20 may be formed of the same material as, or a different material than, heel dampening layer 10, and may be configured to exhibit material properties (such as hardness and/or elasticity) that are the same as or different than those of heel dampening layer 10.

Figure 8:
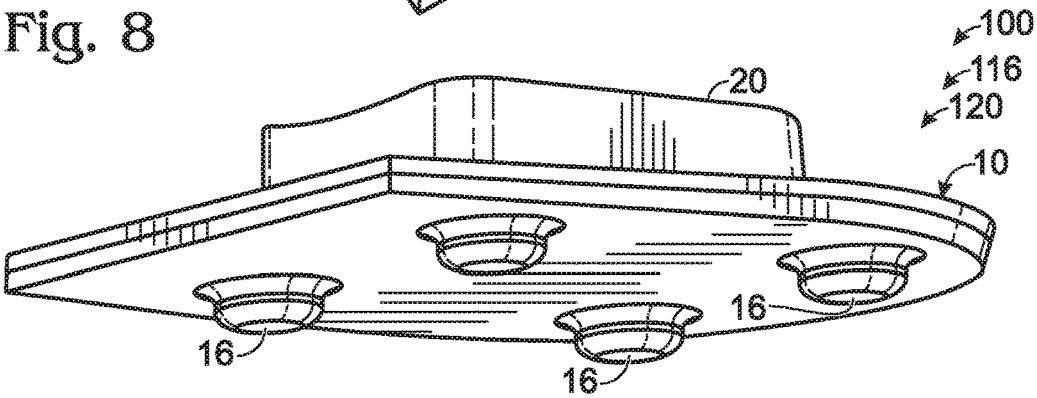
FIG. 8 is a bottom perspective view of a heel dampening layer that may be utilized in heel assemblies with a heel dampening system according to the present disclosure.

Cushioning projection 20 may have any suitable shape. For example, cushioning projection 20 may be generally circular, elliptical, rectangular, or D-shaped in horizontal cross-section, and/or may have a constant, tapered, or varying vertical cross-sectional shape. As further examples, cushioning projection 20 may have sidewalls that are generally not vertical, for example as in a frusto-conical figure, and/or may have a cross-sectional shape whose perimeter exhibits both convex and concave segments, as illustrated in FIGS. 8 and 11.

Figure 9:
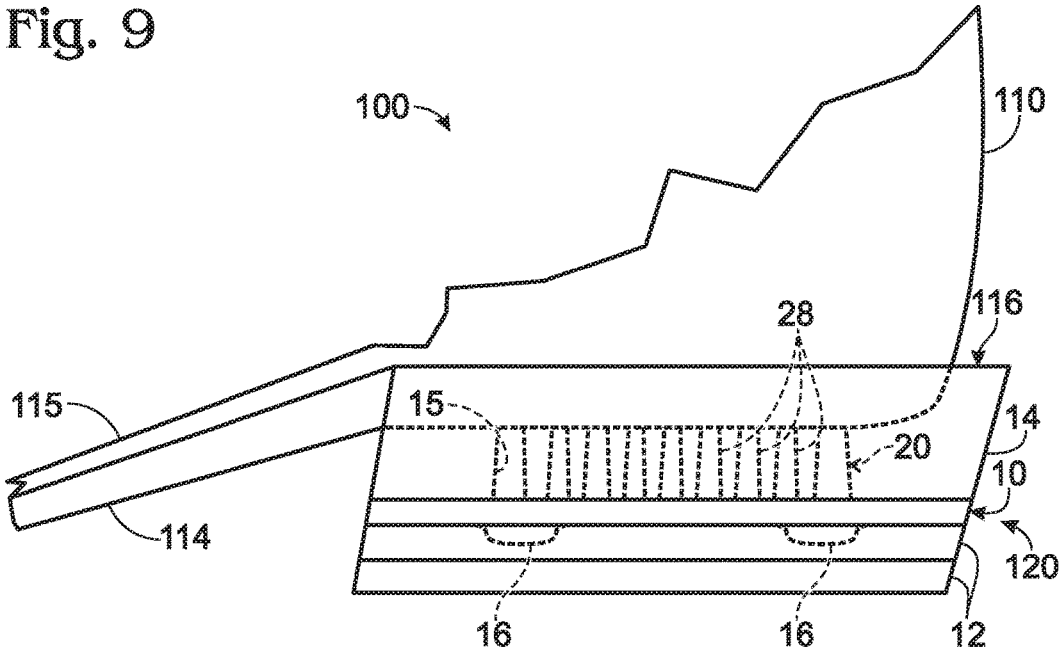
FIG. 9 is a fragmentary side elevation view of a stacked external heel assembly with a heel dampening system according to the present disclosure.

Cushioning projection 20 may include and/or be a uniform and/or unitary component, such as a component of generally constant density and material construction through its volume. Alternatively, and as illustrated schematically in FIG. 2, cushioning projection 20 may include one or more evacuated vertical cores 28, in which case cushioning projection 20 may be referred to as a cored cushioning projection 20. As used herein, evacuated vertical core 28 also may be referred to as a core 28, an evacuated core 28, a vertical core 28, a void 28, a hole 28, a recess 28, a divot 28, a pocket 28, a cell 28, and/or a chamber 28. Additionally, evacuated cores 28 of cored cushioning projection 20 may refer to regions of cored cushioning projection 20 that are filled with and/or constructed of a different material than the body of cushioning projection 20. For example, evacuated cores 28 of cored cushioning projection 20 may be evacuated of all solid material and filled with air, a liquid, and/or a gel. As an additional example, evacuated core 28 of cored cushioning projection 20 may be evacuated of the material of the body of cushioning projection 20 and filled with a different material, such as a material that may be lighter, more resilient, and/or less hard than the material forming the body of cushioning projection 20. It may be desirable to employ a cushioning projection 20 in the form of cored cushioning projection 20, for example, to reduce a total weight of heel assembly 116 and/or to modify the cushioning properties of cushioning projection 20. Examples of cored cushioning projections 20 are illustrated in FIGS. 9-11.

Each evacuated core 28 of cored cushioning projection 20 may extend through an entire vertical extent of cushioning projection 20, or may extend through only a portion of the vertical extent of cushioning projection 20. Additionally or alternatively, evacuated cores 28 of cored cushioning projection 20 may extend into a body of heel dampening layer 10, and optionally may extend fully through a vertical extent of heel dampening layer 10. Alternatively, heel dampening layer 10 may exhibit a cored structure, such as is present in heel dampening layer 10 when evacuated cores 28 of cored cushioning projection 20 extend at least partially into heel dampening layer 10, even in a heel assembly 116 that lacks cored cushioning projection 20.

Evacuated cores 28 of cored cushioning projection 20 may be of any suitable shape, number, and/or configuration such that cushioning projection 20 provides adequate cushioning and/or support to heel assembly 116 of footwear 100. For example, and as illustrated in FIG. 10, cored cushioning projection 20 may include a grid-like array of many (for example, more than eight, more than twelve, or more than twenty) evacuated cores 28, which individually may take the general form of rectangular prisms. Additionally or alternatively, and as illustrated in FIG. 11, cored cushioning projection 20 may include several (for example, fewer than five) evacuated cores 28, which individually may take the general form of right prisms with irregular cross-sectional shapes. Examples of the number of evacuated cores 28 that may be included in cored cushioning projections 20 according to the present disclosure include at least 1, at least 5, at least 10, at least 15, at least 20, at least 25, at least 30, at most 35, at most 30, at most 25, at most 20, at most 15, at most 10, and at most 5.

As schematically illustrated in FIG. 2, heel dampening system 120 and/or heel dampening layer 10 additionally may include one or more positioning elements 16 that may take the form of recesses and/or projections extending from one or more surfaces of heel dampening layer 10. As used herein, positioning elements 16 also may be referred to as heel locators 16 or locating elements 16. Heel locators 16 may be positioned on either or both of the top surface and the bottom surface of heel dampening layer 10, and may be configured to engage with corresponding projections and/or recesses on lower heel layer 12 and/or upper heel layer 14 so as to align heel dampening layer 10 within heel assembly 116 and/or to retain heel dampening layer 10 in a given position within the heel. Heel locators 16 may be extensions of heel dampening layer 10 and/or may be formed of the same material as heel dampening layer 10. Additionally or alternatively, heel locators 16 may be formed of a different material as heel dampening layer 10, and/or may be configured to exhibit different material characteristics, such as hardness or elasticity, than those of heel dampening layer 10.

Figure 6:
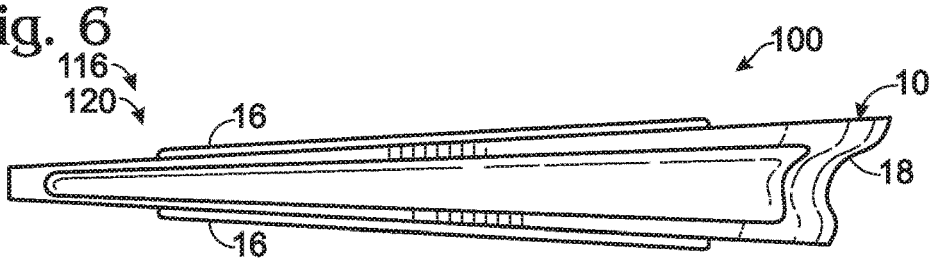
FIG. 6 is a side elevation view of a heel dampening layer that may be utilized in heel assemblies with a heel dampening system according to the present disclosure.
Figure 7:
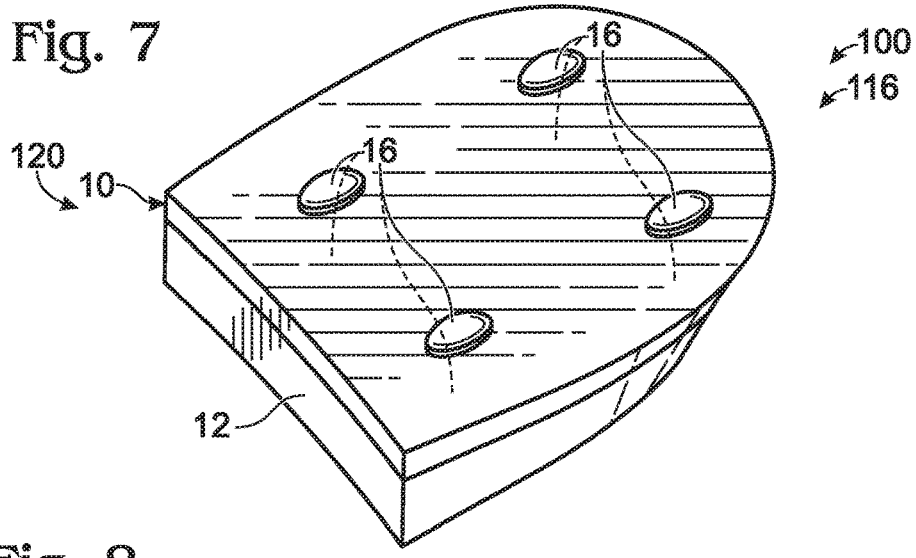
FIG. 7 is a top perspective view of a portion of a stacked external heel assembly with a heel dampening system according to the present disclosure.

FIGS. 6-9 illustrate examples of heel locators 16 that take the form of projections from a surface of heel dampening layer 10. As illustrated in FIG. 6, heel locators 16 may take the form of a pair of elongate ridges on the top and bottom surfaces of heel dampening layer 10, which may be configured to mate with corresponding recesses in lower heel layer 12 and/or in upper heel layer 14. Additionally or alternatively, and as illustrated in FIG. 7, heel locators 16 may take the form of a plurality of spaced-apart generally elliptical projections on the top and bottom surfaces of heel dampening layer 10, which may be configured to mate with corresponding recesses on lower heel layer 12 and/or on upper heel layer 14. Similarly, and as illustrated in FIGS. 8-9, heel locators 16 may take the form of a plurality of spaced-apart, generally hemispherical projections on the bottom surface of heel dampening layer 10, which may be configured to mate with corresponding recesses on lower heel layer 12. Similar heel locators may be on the top surface of the heel dampening layer and configured to mate with corresponding recesses on upper heel layer 14. As illustrated in FIGS. 7-9, heel locators 16 may have generally elliptical and/or circular cross-sectional shapes; however, this is not required, and it is within the scope of the present disclosure that any projecting geometric, symmetric, asymmetric, regular, or irregular shape may be utilized.

In addition to the aforementioned examples, and as discussed, heel locators 16 according to the present disclosure additionally or alternatively may include and/or be recesses in heel dampening layer 10 and/or projections from either or both of lower heel layer 12 and upper heel layer 14. Heel locators 16 may take the form of any suitable number of projections and/or recesses, and may take the form of any suitable shape and may be arranged in any suitable configuration. Further examples of shapes of heel locators 16 include hemispheres, pyramids, cylinders, ellipsoids, trapezoidal prisms, elongated ridges, sawtooth ridges, and variations or combinations thereof.

As schematically illustrated in FIG. 2, heel dampening layer 10 additionally may include at least one sidewall indentation 18. As used herein, sidewall indentation 18 additionally or alternatively may be referred to as a compression curvature 18 and/or a sidewall concavity 18. As illustrated less schematically in FIGS. 4-6, sidewall indentation 18 may take the form of at least one concavity of the exposed sidewall of heel dampening layer 10 with a generally arcuate and/or semicircular profile, and may extend substantially around a perimeter of the exposed sidewall. For example, sidewall indentation 18 may extend substantially, or even fully, around the medial side, the posterior side, and the lateral side of heel dampening layer 10, or may extend around only a portion of the medial side, the posterior side, and/or the lateral side of heel dampening layer 10.

Sidewall indentation 18 may include, and/or be, a single continuous concavity extending around at least a portion of the perimeter of the exposed sidewall, and/or may include a plurality of discrete and/or disconnected concavities distributed along at least a portion of the perimeter of the exposed sidewall. In an embodiment in which sidewall indentation 18 includes a plurality of discrete and/or disconnected concavities, sidewall indentation 18 may refer to an individual concavity, a set of concavities, a subset of the plurality of concavities, and/or an entirety of the plurality of concavities.

The structure of sidewall indentation 18 may allow for and/or augment the capacity for the absorption of mechanical energy by heel dampening layer 10 by increasing the ability of heel dampening layer 10 to compress responsive to a vertically applied impact force. In other words, the indentation of the sidewall of heel dampening layer 10 may allow heel dampening layer 10 to compress by a greater amount, and hence absorb a greater amount of the impact force, relative to a heel dampening layer with generally flat external sidewalls.

Sidewall indentation 18 may be formed by removing material from heel dampening layer 10, or may be formed when molding or fabricating heel dampening layer 10. It also is within the scope of the present disclosure that the profile of sidewall indentation 18 may assume a shape other than an arcuate and/or semicircular shape. For example, the profile of sidewall indentation 18 may be characterized by a generally elliptical, rectangular, or triangular indentation. Additionally or alternatively, sidewall indentation 18 may extend around only a portion of the exposed surface of the sidewall of heel dampening layer 10. For example, sidewall indentation 18 may extend only along the rear-facing portion of the exposed sidewall of heel dampening layer 10, only along the posterior edge of the heel, only along the medial and/or lateral sidewall(s) of the heel, etc.

As schematically illustrated in FIG. 2, heel dampening systems 120 according to the present disclosure may include an assist frame 22, which may be configured to enhance a capacity of heel dampening system 120 and/or heel dampening layer 10 to absorb impact energy in an at least partially reversible and/or at least partially elastic manner. As less schematically illustrated in FIGS. 12-13, assist frame 22 may take the form of a substantially rigid element that extends around at least the perimeters of the top and bottom faces of heel dampening layer 10 and traverses the anterior side of heel dampening layer 10. In this way, assist frame 22 may form a resilient spring generally surrounding the periphery of heel dampening layer 10 with a fulcrum at or near the breast of heel assembly 116. In such a configuration, a compressive flexure of assist frame 22 about an axis near the breast of heel assembly 116 may serve to absorb energy associated with impact events that would otherwise be directed to the foot of the wearer wearing footwear 100. Assist frame 22 further may serve to elastically return at least a portion of the absorbed energy to the heel of the individual as assist frame 22 returns to an uncompressed configuration following the impact event.

Assist frame 22 may be constructed of any appropriate material of sufficient rigidity and/or resiliency so as to provide the elastic energy-absorbing characteristics discussed herein. Examples of materials that may be utilized in assist frame 22 include plastics, nylon, composites, fiberglass, carbon fiber, steel, and polyvinyl chloride (PVC). Assist frame 22 may be attached to or connected to heel dampening layer 10, lower heel layer 12, and/or upper heel layer 14 by any suitable means, examples of which include gluing or otherwise adhering, receiving into molded recesses, and attaching with mechanical fasteners.

Figure 12:
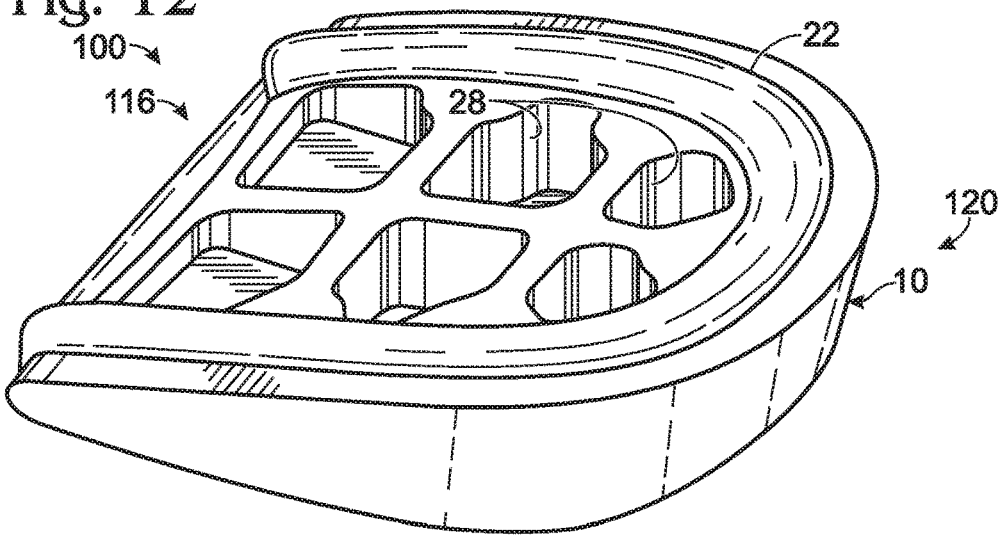
FIG. 12 is a rear top perspective view of a heel dampening layer that may be utilized in heel assemblies with a heel dampening system according to the present disclosure.
Figure 13:
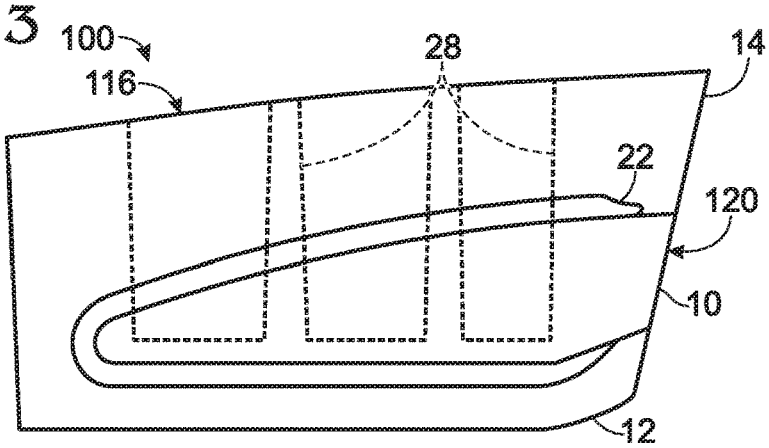
FIG. 13 is a side elevation view of a stacked external heel assembly with a heel dampening system according to the present disclosure.

As illustrated in FIG. 12, assist frame 22 may include a component that connects the lateral and medial sides of assist frame 22 at or near the breast of heel assembly 116. When present, such a connecting element may serve to provide additional structural rigidity to assist frame 22 and/or to heel assembly 116, and/or may be configured to enhance a capacity of assist frame 22 to elastically store and/or return impact energy. Additionally or alternatively, and as illustrated in FIGS. 12-13, assist frame 22 may extend primarily along the periphery of the top and/or bottom faces of heel dampening layer 10, that is, without substantially covering the surface area of the top and/or bottom faces of heel dampening layer 10. For example, assist frame 22 may cover at least 1%, at least 3%, at least 5%, at least 10%, at least 20%, at least 25%, at least 30%, at least 35%, at least 40%, at most 50%, at most 45%, at most 37%, at most 33%, at most 27%, at most 23%, at most 15%, at most 7%, and/or at most 2% of one or each of the top face of heel dampening layer 10 and the bottom face of heel dampening layer 10. It is within the scope of the present disclosure, however, that assist frame 22 additionally or alternatively may substantially cover the surface area of the top and/or bottom faces of heel dampening layer 10. In such a configuration, assist frame 22 additionally or alternatively may be referred to as being and/or including one or more assist plates.

As schematically illustrated in FIG. 2, Heel dampening systems 120 according to the present disclosure additionally or alternatively may include one or more compliance-modifying inserts 24. As less schematically illustrated in FIG. 14, compliance-modifying insert 24 may be an elongated element that is inserted into, inserted through, formed in, and/or otherwise enclosed along at least its length within heel dampening layer 10. When utilized in a heel dampening system 120, compliance-modifying insert may alter the dampening and/or cushioning properties of heel dampening layer 10. Compliance modifying insert 24 may extend partially or completely through heel dampening layer 10 and at any relative orientation. An example of such a relative angular orientation is transverse to a centerline of the heel assembly that is measured in the anterior-posterior direction, as indicated with solid and dashed lead lines 24.

Compliance-modifying insert 24 may be formed of a material that is generally harder, or less compressible, than heel dampening layer 10, or may be formed of a material that is generally softer, or more compressible, than heel dampening layer 10. Therefore, a heel dampening layer 10 that incorporates such a compliance-modifying insert may be more difficult to compress or easier to compress, respectively. Compliance-modifying insert 24 additionally or alternatively may be more or less elastic, rigid, compliant, and/or compressible than the portions of heel dampening layer through which the compliance-modifying insert extends. In this way, compliance-modifying insert 24 may be selected and/or configured to modulate an overall compliance and/or compressibility of heel dampening layer 10.

Compliance-modifying insert 24 may include and/or be a component that is externally visible when heel assembly 116 is installed on footwear 100. Stated differently, compliance-modifying insert 24 may not be entirely enclosed within heel dampening layer 10. Compliance-modifying insert 24 may be fixedly secured within heel dampening layer 10, such that compliance-modifying insert 24 is not configured to be removed from heel dampening layer 10 without damaging compliance-modifying insert 24 and/or heel dampening layer 10. Alternatively, compliance-modifying insert 24 may be configured to be selectively and/or repeatedly inserted into and removed from heel dampening layer 10, such as via a corresponding recess in heel dampening layer 10, without damaging heel dampening layer 10. In this way, the one or more compliance-modifying inserts 24 may be selectively removed from and/or replaced into a given heel dampening layer 10 to yield a variety of heel cushioning characteristics from a given article of footwear 100.

Compliance-modifying insert 24 may be shaped so as to have a generally constant thickness and cross-sectional shape along its length, such as to form a right prism, or may have a thickness that tapers or increases along its length. Compliance-modifying insert 24 may be incorporated into heel dampening layer 10 in such a way that the external sidewall of heel dampening layer 10 is generally coextensive with the outwardly-facing end of compliance-modifying insert 24, such that compliance-modifying insert 24 neither extends from nor is recessed into the external sidewall of heel dampening layer 10. However, this is not required, and it is within the scope of the present disclosure that an outwardly-facing end of compliance-modifying insert 24 may extend beyond or be recessed into the external sidewall of heel dampening layer 10.

Figure 14:
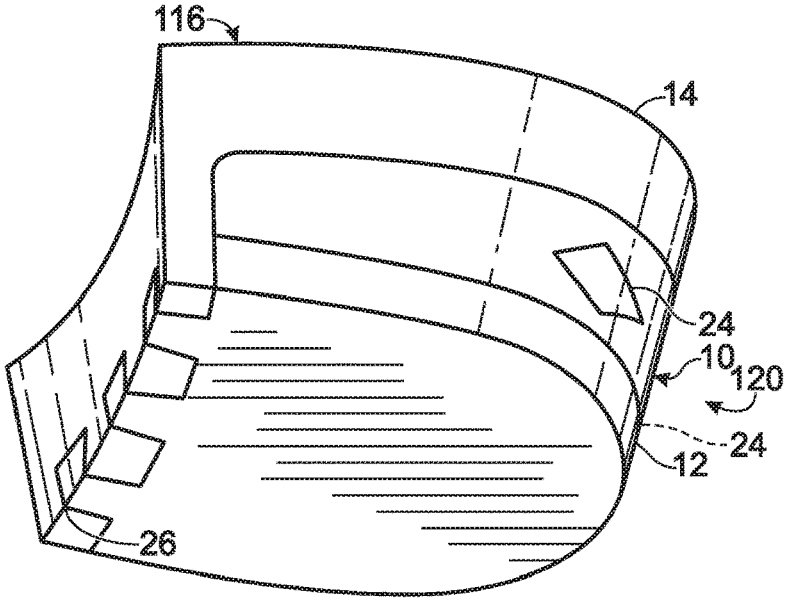
FIG. 14 is a front bottom perspective view of a stacked external heel assembly with a heel dampening system according to the present disclosure.

As illustrated in FIG. 14, compliance-modifying insert 24 may have a cross-sectional shape (as measured in a plane perpendicular to a length of compliance-modifying insert 24) that is in the form of a rhombus. However, this is not required, and it is additionally within the scope of the present disclosure that compliance-modifying insert 24 may have any cross-sectional shape, examples of which may include a circle, a triangle, a rectangle, a star, and combinations and variations thereof.

An effect of compliance-modifying insert 24 on the cushioning properties of heel dampening layer 10 additionally or alternatively may be determined at least in part by the dimensions of compliance-modifying insert 24, such as the relative cross-sectional shape of the compliance-modifying insert, a cross-sectional area of compliance-modifying insert 24, and/or a variation of the cross-sectional area of compliance-modifying insert 24 along its length.

Compliance-modifying insert 24 may be constructed of any material suitable to achieve the desired compliance-modifying effect, such as plastics, nylon, leather, composites, polymers, fiberglass, carbon fiber, steel, foams, and polyvinyl chloride (PVC). It is within the scope of the present disclosure that heel assembly 116 may include any number of compliance-modifying inserts 24, such as one insert, at least one insert, at least three inserts, at least five inserts, at most eight inserts, at most six inserts, and/or at most four inserts. It is within the scope of the present disclosure that compliance-modifying insert 24 additionally or alternatively may be disposed in one or both of lower heel layer 12 and/or upper heel layer 14.

As schematically illustrated in FIG. 2, heel assemblies 116 according to the present disclosure additionally or alternatively may include a heel breast joint 26 that operatively connects lower heel layer 12 and upper heel layer 14 at or near the anterior side of heel assembly 116 and/or the breast of heel assembly 116. As used herein, heel breast joint 26 may not refer to a distinct component of heel assembly 116, but instead may refer to a particular form and/or configuration of an interface, coupling, and/or intersection of lower heel layer 12 and upper heel layer 14.

As discussed herein, in an embodiment in which heel dampening layer 10 does not extend fully from the posterior side of heel assembly 116 to the anterior side of heel assembly 116 and in which lower heel layer 12 and upper heel layer 14 are distinct components, one or both of lower heel layer 12 and upper heel layer 14 may extend at least partially around heel dampening layer 10 at the breast of the heel such that lower heel layer 12 and upper heel layer 14 are in contact. In such a construction, lower heel layer 12 and upper heel layer 14 may be joined at heel breast joint 26, which may serve to increase the strength of the coupling between the two components. As illustrated in FIG. 14, heel breast joint 26 may take the form of a dovetail heel breast joint 26; however, it also is within the scope of the present disclosure that heel breast joint 26 may take the form of any other suitable style of joint, examples of which may include a finger joint, a groove joint, and a miter joint.

The embodiments illustrated in FIGS. 3-14 are non-exclusive and do not limit footwear 100 or heel dampening systems 20 therein to the illustrated embodiments of FIGS. 3-14. That is, footwear 100 and any components thereof, such as heel assemblies 116 and heel dampening systems 20, are not limited to the specific embodiments illustrated in FIGS. 3-14, and footwear 100 according to the present disclosure may incorporate any number of the various aspects, configurations, characteristics, properties, etc. that are illustrated in and discussed with reference to the schematic representations of FIGS. 1-2 and/or the embodiments of FIGS. 3-14, as well as variants thereof, without requiring the inclusion of all such aspects, configurations, characteristics, properties, etc. Additionally or alternatively, footwear 100 and any components thereof may incorporate any number of various aspects, configurations, characteristics, properties, etc. not explicitly discussed herein. For example, footwear 100 and/or sole assembly 112 thereof additionally may include a support plate that may be configured to provide energy return and/or arch support to the wearer, such as is disclosed in U.S. Patent Application Publication No. 2015/0327624, which was filed on May 12, 2015, the complete disclosure of which is hereby incorporated by reference.

As used herein, the terms "selective" and "selectively," when modifying an action, movement, configuration, or other activity of one or more components or characteristics of an apparatus, mean that the specific action, movement, configuration, or other activity is a direct or indirect result of wearer manipulation of an aspect of, or one or more components of, the apparatus.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities, should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

Examples of heel dampening systems according to the present disclosure, and articles of footwear incorporating the same, are presented in the following enumerated paragraphs.

A1. An article of footwear, comprising:

an upper configured to receive a wearer's foot when the footwear is worn by the wearer; and a sole assembly coupled to the upper, wherein the sole assembly comprises a midsole, an outsole beneath the midsole, and a heel assembly, wherein the outsole has an outer surface that is configured to contact a surface on which the wearer is striding;

wherein the heel assembly includes an anterior side, a posterior side, a lateral side, and a medial side, and wherein the heel assembly further includes a heel dampening system, wherein the heel dampening system includes a heel dampening layer that is configured to at least partially absorb an impact force when the heel assembly impacts a ground surface, and further wherein the heel dampening layer forms at least a portion of an exterior surface of the heel assembly.

A2. The article of footwear of paragraph A1, wherein the heel dampening layer is constructed of at least one of ethylene vinyl acetate (EVA), thermoplastic polyurethane (TPU), thermoplastic elastomer (TPE), rubber, a filled shell, a gas-filled shell, and a gel-filled shell.

A3. The article of footwear of any of paragraphs A1-A2, wherein the heel dampening layer has a generally constant thickness, optionally a constant thickness.

A4. The article of footwear of any of paragraphs A1-A2, wherein the heel dampening layer decreases in thickness from the posterior side of the heel assembly toward the anterior side of the heel assembly.

A5. The article of footwear of any of paragraphs A1-A4, wherein the heel dampening layer forms at least a portion of the exterior surface of the posterior side, the lateral side, and the medial side of the heel assembly.

A6. The article of footwear of any of paragraphs A1-A5, wherein the heel dampening layer extends from the lateral side of the heel assembly to the medial side of the heel assembly.

A7. The article of footwear of any of paragraphs A1-A6, wherein the heel dampening layer extends from the posterior side of the heel assembly to the anterior side of the heel assembly.

A8. The article of footwear of any of paragraphs A1-A6, wherein the heel dampening layer extends from the posterior side of the heel assembly toward, but not to, the anterior side of the heel assembly.

A9. The article of footwear of any of paragraphs A1-A8, wherein the heel dampening layer includes one or more evacuated cores extending vertically through at least a portion of the heel dampening layer.

A10. The article of footwear of paragraph A9, wherein the one or more evacuated cores of the heel dampening layer is/are filled with a gas, and optionally with air.

A11. The article of footwear of paragraph A9, wherein the one or more evacuated cores of the heel dampening layer is/are at least partially, and optionally fully, filled with at least one of a gel, a liquid, and a solid material.

A12. The article of footwear of any of paragraphs A9-A11, wherein the heel dampening layer includes one, at least 1, at least 5, at least 10, at least 15, at least 20, at least 25, at least 30, at most 35, at most 30, at most 25, at most 20, at most 15, at most 10, and/or at most 5 evacuated cores.

A13. The article of footwear of any of paragraphs A1-A12, wherein the heel assembly further includes a lower heel layer that is located generally below the heel dampening layer.

A14. The article of footwear of paragraph A13, wherein the lower heel layer extends from the posterior side of the heel assembly to the anterior side of the heel assembly.

A15. The article of footwear of any of paragraphs A13-A14, wherein the lower heel layer extends from the lateral side of the heel assembly to the medial side of the heel assembly.

A16. The article of footwear of any of paragraphs A13-A15, wherein the lower heel layer further extends upward along an anterior side of the heel dampening layer.

A17. The article of footwear of any of paragraphs A13-A16, wherein the lower heel layer includes a surface that is configured to contact a surface upon which a wearer of the article of footwear that includes the heel dampening system is striding.

A18. The article of footwear of any of paragraphs A13-A17, wherein the lower heel layer is at least one of harder and less resilient than the heel dampening layer.

A19. The article of footwear of any of paragraphs A13-A18, wherein the lower heel layer is constructed of at least one of rubber, leather, resins, and polymers.

A20. The article of footwear of any of paragraphs A1-A19, wherein the heel assembly further includes an upper heel layer that is located generally above the heel dampening layer.

A21. The article of footwear of paragraph A20, wherein the upper heel layer extends from the posterior side of the heel assembly to the anterior side of the heel assembly.

A22. The article of footwear of any of paragraphs A20-A21, wherein the upper heel layer extends from the lateral side of the heel assembly to the medial side of the heel assembly.

A23. The article of footwear of any of paragraphs A20-A22, wherein the upper heel layer further extends downward along the anterior side of the heel dampening layer.

A24. The article of footwear of any of paragraphs A20-A23, wherein the upper heel layer includes a surface that is configured to engage with at least one of an outsole and a midsole of the article of footwear that includes the heel dampening system.

A25. The article of footwear of any of paragraphs A20-A24, wherein the upper heel layer is at least one of harder and less resilient than the heel dampening layer.

A26. The article of footwear of any of paragraphs A20-A25, wherein the upper heel layer is constructed of at least one of rubber, leather, resins, and polymers.

A27. The article of footwear of any of paragraphs A13-A26, when dependent on both paragraphs A13 and A20, wherein the lower heel layer and the upper heel layer are integrally formed as a unitary component that substantially contacts lower, upper, and anterior sides of the heel dampening layer.

A28. The article of footwear of any of paragraphs A1-A27, wherein the heel assembly includes a rigid heel breast that forms the anterior side of the heel assembly, and optionally wherein the heel dampening layer engages the rigid heel breast.

A29. The article of footwear of any of paragraphs A1-A28, wherein the heel dampening system includes one or more positioning elements, wherein the one or more positioning elements is/are configured to maintain the orientation of the heel dampening layer with respect to at least one adjacent layer of the heel assembly, and optionally wherein the one or more positioning elements form a portion of the heel dampening layer.

A30. The article of footwear of paragraph A29, wherein the one or more positioning elements include one or more projections from a top surface of the heel dampening layer.

A31. The article of footwear of paragraph A30, wherein the one or more positioning elements is/are configured to engage with corresponding recesses in a/the upper heel layer.

A32. The article of footwear of any of paragraphs A29-A31, wherein the one or more positioning elements include one or more recesses into a/the top surface of the heel dampening layer.

A33. The article of footwear of paragraph A32, wherein the one or more positioning elements is/are configured to engage with corresponding projections in a/the upper heel layer.

A34. The article of footwear of any of paragraphs A29-A33, wherein the one or more positioning elements include one or more projections from a bottom surface of the heel dampening layer.

A35. The article of footwear of paragraph A34, wherein the one or more positioning elements is/are configured to engage with corresponding recesses in a/the lower heel layer.

A36. The article of footwear of any of paragraphs A29-A35, wherein the one or more positioning elements include one or more recesses into a/the bottom surface of the heel dampening layer.

A37. The article of footwear of paragraph 36, wherein the one or more positioning elements is/are configured to engage with corresponding projections in a/the lower heel layer.

A38. The article of footwear of any of paragraphs A29-A37, wherein the one or more positioning elements include one or more elongated ridges or elongated recesses.

A39. The article of footwear of any of paragraphs A29-A38, wherein the one or more positioning elements include one or more spaced-apart projections or recesses, and wherein the one or more spaced-apart projections or recesses is/are in the shape of one or more of circles, hemispheres, pyramids, cylinders, ellipsoids, trapezoidal prisms, sawtooth ridges, and variations or combinations thereof.

A40. The article of footwear of any of paragraphs A29-A39, wherein the heel assembly includes one, at least one, at least three, at least five, at most eight, at most six, and/or at most four positioning elements.

A41. The article of footwear of any of paragraphs A1-A40, wherein the heel dampening layer includes a sidewall indentation, and optionally wherein the sidewall indentation is a concave indentation of an external sidewall of the heel dampening layer.

A42. The article of footwear of paragraph A41, wherein the sidewall indentation is configured to increase the ability of the heel dampening layer to compress in response to a vertically-applied force relative to a corresponding heel dampening layer that has generally flat sidewalls instead of the concave indentation.

A43. The article of footwear of any of paragraphs A41-A42, wherein the profile of the concave indentation is at least one of circular, elliptical, rectangular, triangular, and variations or combinations thereof.

A44. The article of footwear of any of paragraphs A41-A43, wherein the sidewall indentation extends substantially around a portion of, and optionally at least 50% of, the perimeter of the external sidewall of the heel dampening layer.

A45. The article of footwear of any of paragraphs A41-A44, wherein the sidewall indentation extends substantially around medial, lateral, and posterior sides of the external sidewall of the heel dampening layer.

A46. The article of footwear of any of paragraphs A41-A45, wherein the sidewall indentation extends substantially around a/the posterior side of the external sidewall of the heel dampening layer.

A47. The article of footwear of any of paragraphs A1-A46, wherein the heel dampening system further includes a cushioning projection that extends at least partially into at least one component of the sole assembly above the heel dampening layer.

A48. The article of footwear of paragraph A47, wherein the cushioning projection is coupled to at least one of the heel dampening layer and the midsole.

A49. The article of footwear of any of paragraphs A47-A48, wherein the cushioning projection is positioned to lie generally underneath the calcaneus bone of the wearer's foot.

A50. The article of footwear of any of paragraphs A47-A49, wherein the cushioning projection is formed of at least one of ethylene vinyl acetate (EVA), thermoplastic polyurethane (TPU), thermoplastic elastomer (TPE), rubber, a filled shell, a gas-filled shell, and a gel-filled shell.

A51. The article of footwear of any of paragraphs A47-A50, wherein the cushioning projection is formed of the same material as the heel dampening layer.

A52. The article of footwear of any of paragraphs A47-A51, wherein the cushioning projection is formed of a different material than the heel dampening layer.

A53. The article of footwear of any of paragraphs A47-A52, wherein the cushioning projection is integrally formed with the heel dampening layer.

A54. The article of footwear of any of paragraphs A47-A53, wherein the cushioning projection is formed separately from and subsequently attached to the heel dampening layer.

A55. The article of footwear of any of paragraphs A47-A54, wherein the cross-sectional shape of the cushioning projection is one or more of circular, elliptical, rectangular, or D-shaped.

A56. The article of footwear of any of paragraphs A47-A55, wherein at least one sidewall, and optionally all of the sidewalls, of the cushioning projection are vertical.

A57. The article of footwear of any of paragraphs A47-A56, wherein at least one sidewall, and optionally all of the sidewalls, of the cushioning projection are tapered.

A58. The article of footwear of any of paragraphs A47-A57, wherein the cushioning projection extends at least partially, and optionally fully, through a/the upper heel layer.

A59. The article of footwear of paragraph A58, wherein the cushioning projection further extends at least partially, and optionally fully, through the outsole of the footwear.

A60. The article of footwear of paragraph A59, wherein the cushioning projection further extends at least partially, and optionally fully, through the midsole of the footwear.

A61. The article of footwear of paragraph A60, wherein a top surface of the cushioning projection is coplanar with a top surface of the midsole.

A62. The article of footwear of any of paragraphs A47-A61, wherein the cushioning projection has a constant density throughout its volume.

A63. The article of footwear of any of paragraphs A47-A62, wherein the cushioning projection includes one or more evacuated cores.

A64. The article of footwear of paragraph A63, wherein the one or more evacuated cores of the cushioning projection extend vertically through the cushioning projection.

A65. The article of footwear of paragraph A64, wherein the one or more evacuated cores of the cushioning projection extend only through a portion of the full vertical extent of the cushioning projection.

A66. The article of footwear of paragraph A64, wherein the one or more evacuated cores of the cushioning projection extend through the full vertical extent of the cushioning projection.

A67. The article of footwear of any of paragraphs A63-A66, wherein the one or more evacuated cores of the cushioning projection extend into the heel dampening layer.

A68. The article of footwear of any of paragraphs A63-A67, wherein the one or more evacuated cores of the cushioning projection is/are filled with a gas, and optionally with air.

A69. The article of footwear of any of paragraphs A63-A67, wherein the one or more evacuated cores of the cushioning projection is/are filled with at least one of a gel, a liquid, and/or a solid material.

A70. The article of footwear of any of paragraphs A63-A69, wherein the cushioning projection includes one, at least 1, at least 5, at least 10, at least 15, at least 20, at least 25, at least 30, at most 35, at most 30, at most 25, at most 20, at most 15, at most 10, and/or at most 5 evacuated cores.

A71. The article of footwear of any of paragraphs A1-A70, wherein the heel dampening system further includes an assist frame that is configured to absorb and at least partially return impact energy responsive to a vertically applied force.

A72. The article of footwear of paragraph A71, wherein the assist frame is formed of a substantially rigid material.

A73. The article of footwear of any of paragraphs A71-A72, wherein the assist frame is formed of at least one of plastic, nylon, fiberglass, carbon fiber, steel, and polyvinyl chloride (PVC).

A74. The article of footwear of any of paragraphs A71-A73, wherein the assist frame extends substantially around at least the perimeters of a/the top and bottom surfaces of the heel dampening layer and connects at a/the anterior side of the heel dampening layer.

A75. The article of footwear of paragraph A74, wherein portions of the top and bottom surfaces of the heel dampening layer that are contacted by the assist frame are annular in shape.

A76. The article of footwear of any of paragraphs A71-A75, wherein the assist frame acts as a spring with a fulcrum proximal a/the anterior side of the heel dampening layer.

A77. The article of footwear of any of paragraphs A71-A76, wherein the assist frame at least partially surrounds and/or encloses the heel dampening layer.

A78. The article of footwear of any of paragraphs A71-A77, wherein the assist frame is received into recesses in one or more of the heel dampening layer, a/the lower heel layer, and a/the upper heel layer.

A79. The article of footwear of any of paragraphs A71-A78, wherein the assist frame substantially covers one or both of a/the top and bottom surfaces of the heel dampening layer.

A80. The article of footwear of any of paragraphs A1-A79, wherein the heel dampening system further includes one or more compliance-modifying inserts that is/are at least partially incorporated into and/or extend into the heel dampening layer.

A81. The article of footwear of paragraph A80, wherein the one or more compliance-modifying inserts is/are formed of a material that is more difficult to compress than the heel dampening layer.

A82. The article of footwear of paragraph A81, wherein the one or more compliance-modifying inserts is/are formed of a material that is at least one of harder than, more rigid than, and stiffer than the heel dampening layer.

A83. The article of footwear of paragraph A80, wherein the one or more compliance-modifying inserts is/are formed of a material that is easier to compress and/or more compliant than the heel dampening layer.

A84. The article of footwear of any of paragraphs A80 or A83, wherein the one or more compliance-modifying inserts is/are formed of a material that is softer than the heel dampening layer.

A85. The article of footwear of any of paragraphs A80-A84, wherein the one or more compliance-modifying inserts have a generally constant thickness along their length.

A86. The article of footwear of any of paragraphs A80-A84, wherein the one or more compliance-modifying inserts have a thickness that varies along their length.

A87. The article of footwear of any of paragraphs A80-A86, wherein the one or more compliance-modifying inserts have an end surface that is/are generally coextensive with a/the sidewalls of the heel dampening layer and is/are externally visible.

A88. The article of footwear of any of paragraphs A80-A87, wherein the one or more compliance-modifying inserts have a cross-sectional shape that is one or more of a rhombus, a circle, a triangle, a rectangle, a star, and combinations or variations thereof.

A89. The article of footwear of any of paragraphs A80-A88, wherein the heel dampening layer includes one, at least one, at least three, at least five, at most eight, at most six, and/or at most four compliance-modifying inserts.

A90. The article of footwear of any of paragraphs A80-A89, wherein the one or more compliance-modifying inserts are configured to be removably received into one or more apertures in the heel dampening layer.

A91. The article of footwear of any of paragraphs A1-A90, when dependent on paragraph A8, wherein the heel assembly further includes a heel breast joint that connects a/the lower heel layer and a/the upper heel layer at or near the anterior side of the heel assembly.

A92. The article of footwear of paragraph A91, wherein the heel breast joint is one of a dovetail joint, a finger joint, a groove joint, and a miter joint.

A93. The article of footwear of any of paragraphs A1-A92, wherein the article of footwear is a boot.

A94. The article of footwear of any of paragraphs A1-A93, wherein the heel assembly is an external heel assembly that projects from the outsole.

A95. The article of footwear of any of paragraphs A1-A94, wherein the heel assembly is a stacked heel assembly.

A96. The article of footwear of any of paragraphs A1-A92, wherein the article of footwear is at least one of an athletic shoe, a casual shoe, and an outdoor shoe.

INDUSTRIAL APPLICABILITY

The present disclosure is applicable to the footwear industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. An article of footwear, comprising:

an upper configured to receive a wearer's foot when the footwear is worn by the wearer; and a sole assembly coupled to the upper;

wherein the sole assembly includes a midsole, an outsole, and a heel assembly positioned adjacent to a posterior region of the outsole;

wherein the outsole has an outer surface configured to contact a ground surface on which the wearer is striding;

wherein the heel assembly includes an anterior side, a posterior side, a lateral side, and a medial side; and wherein the heel assembly further includes an upper heel layer, a lower heel layer, and a heel dampening system;

wherein the upper heel layer is located generally above the heel dampening system and extends from the medial side of the heel assembly to the lateral side of the heel assembly, and wherein the upper heel layer includes a cushion aperture that extends through the upper heel layer from an upper surface of the upper heel layer to a lower surface of the upper heel layer;

wherein the lower heel layer is located generally below the heel dampening system and extends from the medial side of the heel assembly to the lateral side of the heel assembly; and wherein the heel dampening system includes a heel dampening layer that is configured to at least partially absorb an impact force when the heel assembly impacts the ground surface; wherein the heel dampening layer extends from the medial side of the heel assembly to the lateral side of the heel assembly and extends from the posterior side of the heel assembly toward, but not to, the anterior side of the heel assembly; wherein the heel dampening layer forms at least a portion of an exterior surface of the posterior side of the heel assembly, at least a portion of an exterior surface of the lateral side of the heel assembly, and at least a portion of an exterior surface of the medial side of the heel assembly; wherein at least one of the lower heel layer and the upper heel layer extends at least partially around the heel dampening layer such that the lower heel layer and the upper heel layer are in contact; and wherein the heel dampening system further includes a cushioning projection that extends from the heel dampening layer and that extends at least partially through the cushion aperture in the upper heel layer.

2. The article of footwear of claim 1, wherein the cushioning projection is positioned to lie generally underneath a calcaneus bone of the wearer's foot when the footwear is worn by the wearer.

3. The article of footwear of claim 1, wherein the cushioning projection is integrally formed with the heel dampening layer.

4. The article of footwear of claim 1, wherein the cushioning projection extends partially through the cushion aperture, and wherein a top surface of the cushioning projection extends to a point below a top surface of the upper heel layer.

5. The article of footwear of claim 1, wherein the cushioning projection extends fully through the cushion aperture, and wherein a top surface of the cushioning projection is generally coextensive with a top surface of the upper heel layer.

6. The article of footwear of claim 1, wherein the cushioning projection extends fully through the cushion aperture, and wherein a top surface of the cushioning projection extends above a top surface of the upper heel layer.

7. The article of footwear of claim 1, wherein the sole assembly further includes a shank that reinforces at least an arch region of the sole assembly.

8. The article of footwear of claim 1, wherein the heel assembly is a stacked heel assembly in which the lower heel layer, the heel dampening layer, and the upper heel layer are arranged in a generally stacked configuration.

9. The article of footwear of claim 1, wherein the heel assembly is an external heel assembly that projects from the outsole.

10. The article of footwear of claim 1, wherein the upper heel layer is positioned entirely above the heel dampening layer.

11. The article of footwear of claim 1, wherein the upper heel layer extends downward along an anterior side of the heel dampening layer to meet the lower heel layer.

12. The article of footwear of claim 1, wherein the lower heel layer is positioned entirely below the heel dampening layer.

13. The article of footwear of claim 1, wherein the lower heel layer extends upward along an anterior side of the heel dampening layer to meet the upper heel layer.

14. The article of footwear of claim 1, wherein the heel dampening layer has a generally constant thickness.

15. The article of footwear of claim 1, wherein the lower heel layer and the upper heel layer each are less resilient than the heel dampening layer.

16. The article of footwear of claim 1, wherein the lower heel layer and the upper heel layer are joined at a heel breast joint located proximal the anterior side of the heel assembly relative to the posterior side of the heel assembly.

17. The article of footwear of claim 16, wherein the heel dampening layer contacts a posterior side of the heel breast joint.

18. The article of footwear of claim 1, wherein the sole assembly further includes a support plate configured to provide arch support in a midfoot region of the support plate; wherein the support plate is positioned generally above the outsole.

19. The article of footwear of claim 18, wherein the support plate includes a support plate heel portion configured to be positioned generally under a heel of the wearer's foot when the article of footwear is worn by the wearer and a support plate midfoot portion positioned generally under a midfoot region of the wearer's foot when the article of footwear is worn by the wearer, wherein the support plate midfoot portion is integrally formed with the support plate heel portion, and wherein the support plate heel portion includes a through-hole extending from an upper surface of the support plate to a lower surface of the support plate.

20. The article of footwear of claim 19, wherein the support plate heel portion is configured to provide heel cushioning to the heel of the wearer's foot when the footwear is worn by the wearer.

21. The article of footwear of claim 1, wherein the cushioning projection extends fully through the cushion aperture and at least partially through the outsole.

22. The article of footwear of claim 1, wherein the cushioning projection extends fully through the cushion aperture and the outsole and at least partially through the midsole.

23. The article of footwear of claim 22, wherein the cushioning projection extends partially through the midsole, and wherein a top surface of the cushioning projection extends to a point below a top surface of the midsole.

24. The article of footwear of claim 22, wherein the cushioning projection extends fully through the midsole, and wherein a top surface of the cushioning projection is coextensive with a top surface of the midsole.

25. The article of footwear of claim 22, wherein the cushioning projection extends fully through the midsole, and wherein a top surface of the cushioning projection extends to a point above a top surface of the midsole.

* * * * *